US009067426B2

(12) United States Patent
Urabe

(10) Patent No.: US 9,067,426 B2
(45) Date of Patent: Jun. 30, 2015

(54) INK CARTRIDGE ASSEMBLY, CARTRIDGE ASSEMBLY KIT, AND PRINTER

(71) Applicant: SEIKO EPSON CORPORATION, Tokyo (JP)

(72) Inventor: Yuichi Urabe, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/484,274

(22) Filed: Sep. 12, 2014

(65) Prior Publication Data

US 2015/0022598 A1 Jan. 22, 2015

Related U.S. Application Data

(62) Division of application No. 13/281,745, filed on Oct. 26, 2011, now Pat. No. 8,864,291.

(30) Foreign Application Priority Data

Nov. 1, 2010 (JP) ..... 2010-245029

(51) Int. Cl.
*B41J 2/175* (2006.01)

(52) U.S. Cl.
CPC ..... *B41J 2/17559* (2013.01); *Y10T 29/53* (2015.01); *B41J 2/1752* (2013.01); *B41J 2/17553* (2013.01); *B41J 2/17523* (2013.01)

(58) Field of Classification Search
USPC ..... 347/49, 85, 86
See application file for complete search history.

(56) References Cited

U.S. PATENT DOCUMENTS

| | | | | |
|---|---|---|---|---|
| 5,646,658 | A * | 7/1997 | Thiel et al. | 347/49 |
| 6,267,475 | B1 | 7/2001 | Lee et al. | |
| 6,402,298 | B1 | 6/2002 | Nanjo et al. | |
| 6,505,926 | B1 | 1/2003 | Trafton et al. | |
| 7,101,022 | B2 | 9/2006 | Mui et al. | |
| 7,946,694 | B2 * | 5/2011 | Hagiwara et al. | 347/85 |
| 8,349,486 | B2 | 1/2013 | Lee et al. | |
| 2004/0016455 | A1 | 1/2004 | Oogami | |
| 2005/0208375 | A1 | 9/2005 | Sakurai | |
| 2008/0043074 | A1 * | 2/2008 | Hagiwara et al. | 347/85 |

FOREIGN PATENT DOCUMENTS

| | | | | |
|---|---|---|---|---|
| EP | 0615844 A1 | | 9/1994 | |
| JP | 9-44056 A | | 2/1997 | |
| JP | 2008-044257 | * | 2/2008 | B41J 2/175 |
| JP | 2009-184283 | * | 8/2009 | B41J 2/175 |

OTHER PUBLICATIONS

Extended European Search Report dated Feb. 9, 2012, corresponding to European patent application No. 11187015.0.

* cited by examiner

*Primary Examiner* — Huan Tran
(74) *Attorney, Agent, or Firm* — Lowe Hauptman & Ham, LLP

(57) ABSTRACT

A cartridge assembly includes a plurality of ink cartridges each having a cartridge case that holds ink therein, and at least one connecting member that connects the plurality of ink cartridges together in a connection direction. The ink cartridges connected by the at least one connecting member are movable relative to each other in the connection direction of the ink cartridges.

15 Claims, 6 Drawing Sheets

INK CARTRIDGE ASSEMBLY, CARTRIDGE ASSEMBLY KIT, AND PRINTER

RELATED APPLICATION (S)

The instant application is a divisional of U.S. patent application Ser. No. 13/281, 745 filed Oct. 26, 2011 and claims the benefit of Japanese patent application No. 2010-245029 filed Nov. 1, 2010, all of which are incorporated by reference herein.

BACKGROUND

1. Technical Field

The present disclosure relates to an ink cartridge assembly, a kit for forming an ink cartridge assembly, and a printer, and more particularly, to an ink cartridge assembly having a plurality of interconnected ink cartridges.

2. Related Art

Japanese Unexamined Patent Appl. Pub. JP-A-2008-44257 describes an inkjet printer that prints by supplying ink from an ink cartridge to a printhead and ejecting ink from the printhead onto the print medium.

If the frequency of ink cartridge replacement is reduced, the printer can be used continuously for a longer period of time before replacing the ink cartridge. An approach includes increasing the size of the ink cartridge and increasing the ink cartridge capacity. However, designing and manufacturing a new ink cartridge with greater ink capacity also increases cost.

Another approach is to connect plural existing ink cartridges with a known ink capacity into a single integrated cartridge assembly, and install this cartridge assembly into a cartridge holder.

However, the inventors have recognized the following potential issues.

Because the outside dimensions of the ink cartridges can vary slightly, variation in the outside dimensions of the cartridge assembly can increase when plural ink cartridges are connected together, and the installation of the cartridge assembly into the cartridge holder may be difficult or even impossible.

More specifically, when plural ink cartridges are connected in series, the dimensional deviations of the individual ink cartridges accumulate in the direction in which the ink cartridges are connected, and the cumulative dimensional error in the direction in which the ink cartridges are connected can be greater than an acceptable tolerance.

In order to align the ink supply openings of the cartridge assembly with the supply needles of the cartridge holder when the cartridge assembly is installed into the cartridge holder, positioning members including a positioning hole and a positioning pin are generally disposed to the cartridge assembly and the cartridge holder. To reliably prevent the cartridge assembly and cartridge holder from shifting relative to each other, these positioning members are generally disposed to at least two places on the cartridge assembly and the cartridge holder.

However, the distance between the two positioning members (e.g., holes) disposed to the cartridge assembly may become too large or too small as a result of the cumulative dimensional error of the ink cartridges in the direction in which the ink cartridges are connected. As a result, it may be difficult or even impossible to fit the positioning holes in the cartridge assembly onto the positioning pins disposed to the cartridge holder. If the size of the positioning holes is increased to accommodate this cumulative dimensional error, the connection between the enlarged positioning holes and the respective positioning pins may become loose.

SUMMARY

In an aspect, a cartridge assembly includes a plurality of ink cartridges each having a cartridge case that holds ink therein, and at least one connecting member that connects the plurality of ink cartridges together in a connection direction. The ink cartridges connected by the at least one connecting member are movable relative to each other in the connection direction of the ink cartridges.

In another aspect, a printer includes a cartridge holder having a cartridge assembly compartment, a cartridge assembly as defined above and installable in the cartridge assembly compartment, and a printing mechanism for printing with ink supplied from the ink cartridge.

In a further aspect, a kit for assembling a plurality of ink cartridges in a connection direction into a cartridge assembly includes at least one first connecting member, at least one second connecting member and at least one elastic member. The first connecting member includes a first interface part to be placed between adjacent ink cartridges to be connected by the first connecting member, at least two first protruding parts that extend from the first interface part in mutually opposite ways along the connection direction, and a first engaging part disposed at the distal end of each first protruding part for engagement with engaged parts of the adjacent ink cartridges. The ink cartridges connected by the first connecting member are not moveable relative to each other in the connection direction or are moveable relative to each other in the connection direction within a limited play. The second connecting member includes a second interface part adapted to be placed between adjacent ink cartridges to be connected by the second connecting member, at least two second protruding parts that extend from the second interface part in the mutually opposite ways along the connection direction, and a second engaging part disposed at the distal end of each second protruding part for engagement with engaged parts of the adjacent ink cartridges. The ink cartridges connected by the second connecting member are moveable relative to each other in the connection direction within a predetermined distance greater than the limited play permitted by the first connecting member. The elastic member is adapted to be disposed between the adjacent ink cartridges connected by the second connecting member. The elastic member is elastically deformable to enable the adjacent ink cartridges connected by the second connecting member to move relative to each other in the connection direction within the predetermined distance.

DESCRIPTION OF EXEMPLARY EMBODIMENTS

Exemplary embodiments of the present invention will be described below with reference to the accompanying figures.

Figure 1:
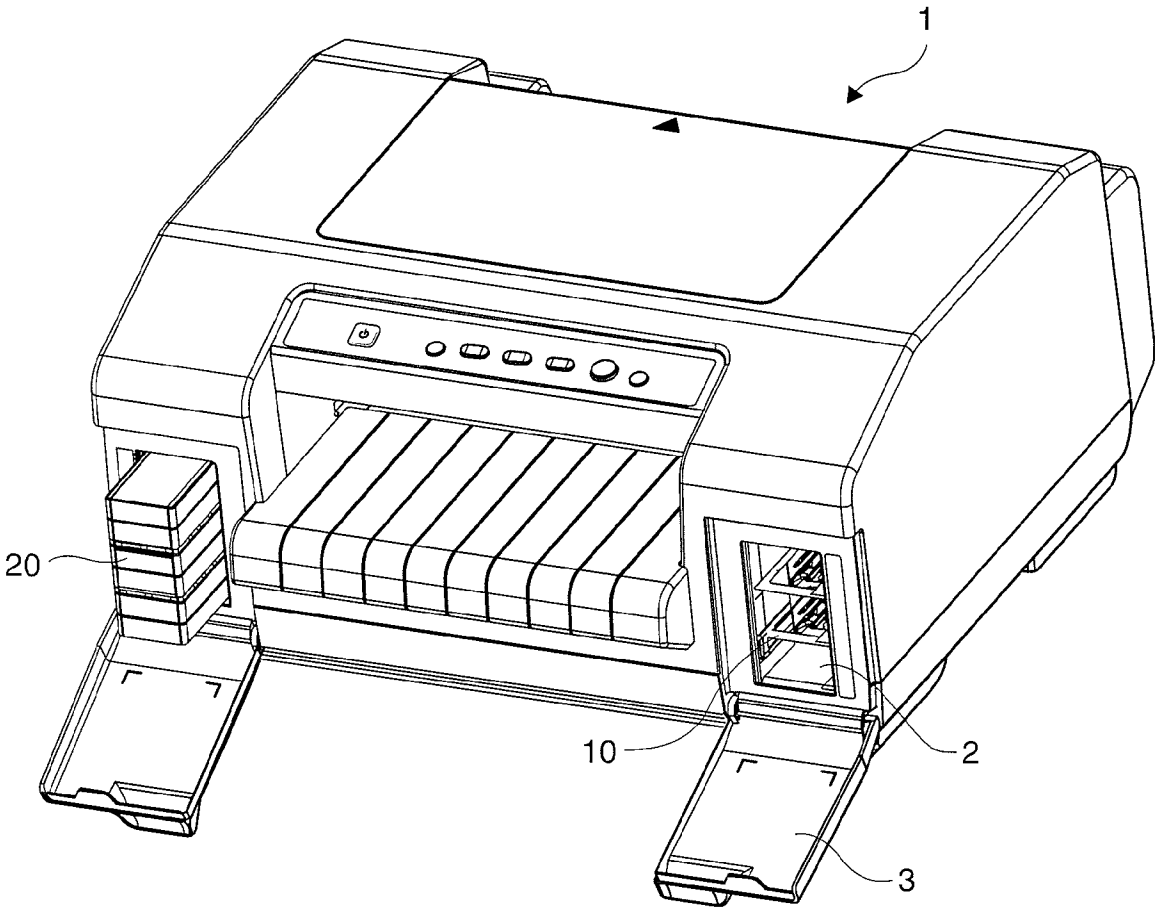
FIG. 1 is a perspective view of a printer according to some embodiments of the invention.

FIG. 1 is a perspective view of a printer 1 according to some embodiments of the invention. This printer 1 is an inkjet printer, and has a cartridge compartment 2 that can be closed by a cover 3 disposed on each side of the front of the printer 1 as shown in FIG. 1. The invention is, however, not limited to inkjet printers and is applicable to any printing machines that use interconnected ink cartridges. For example, some embodiments include laser printers.

As used herein, "front" denotes the front of the printer 1, and refers to the front as seen in FIG. 1.

Figure 2:
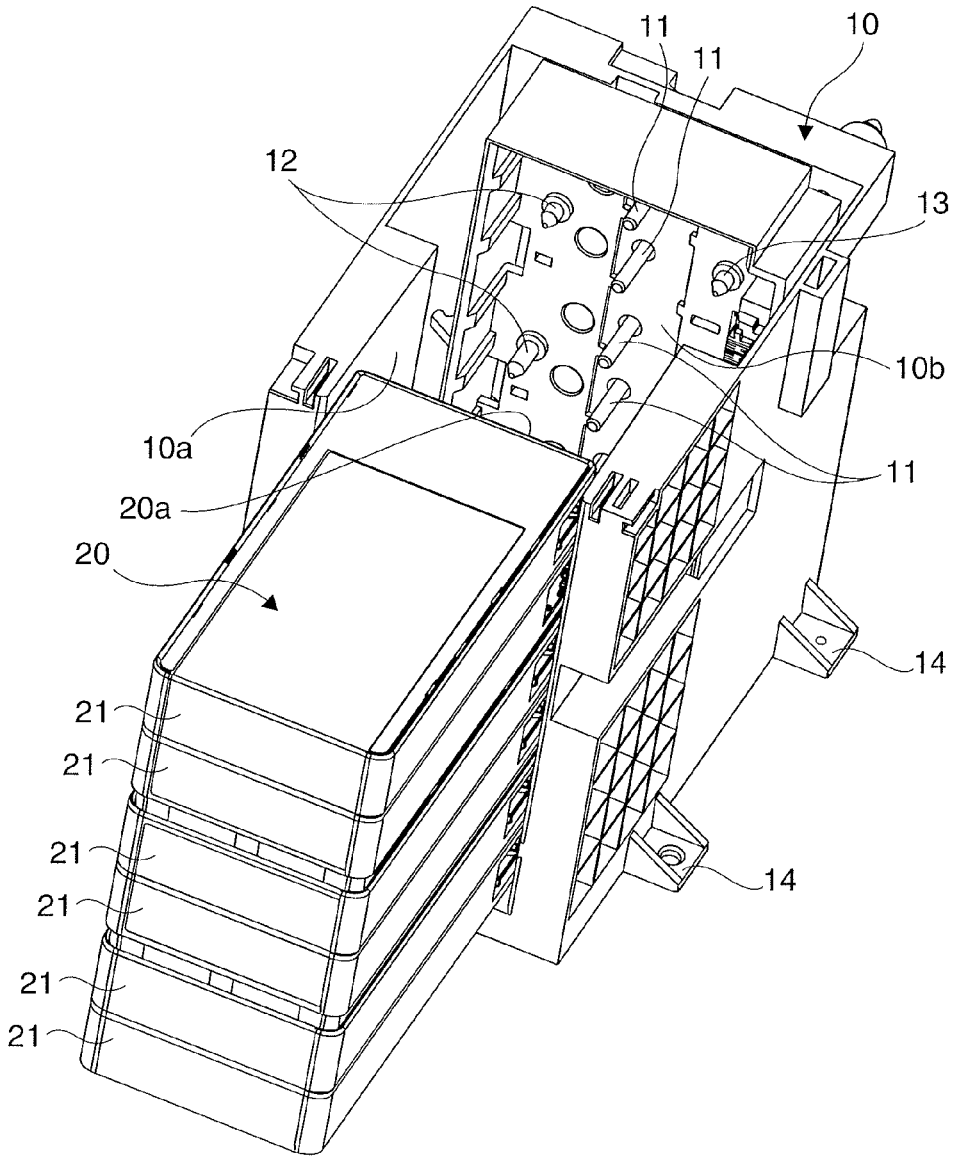
FIG. 2 is a perspective view of a cartridge holder and a cartridge assembly in accordance with some embodiments, for use in the printer shown in FIG. 1.
Figure 3:
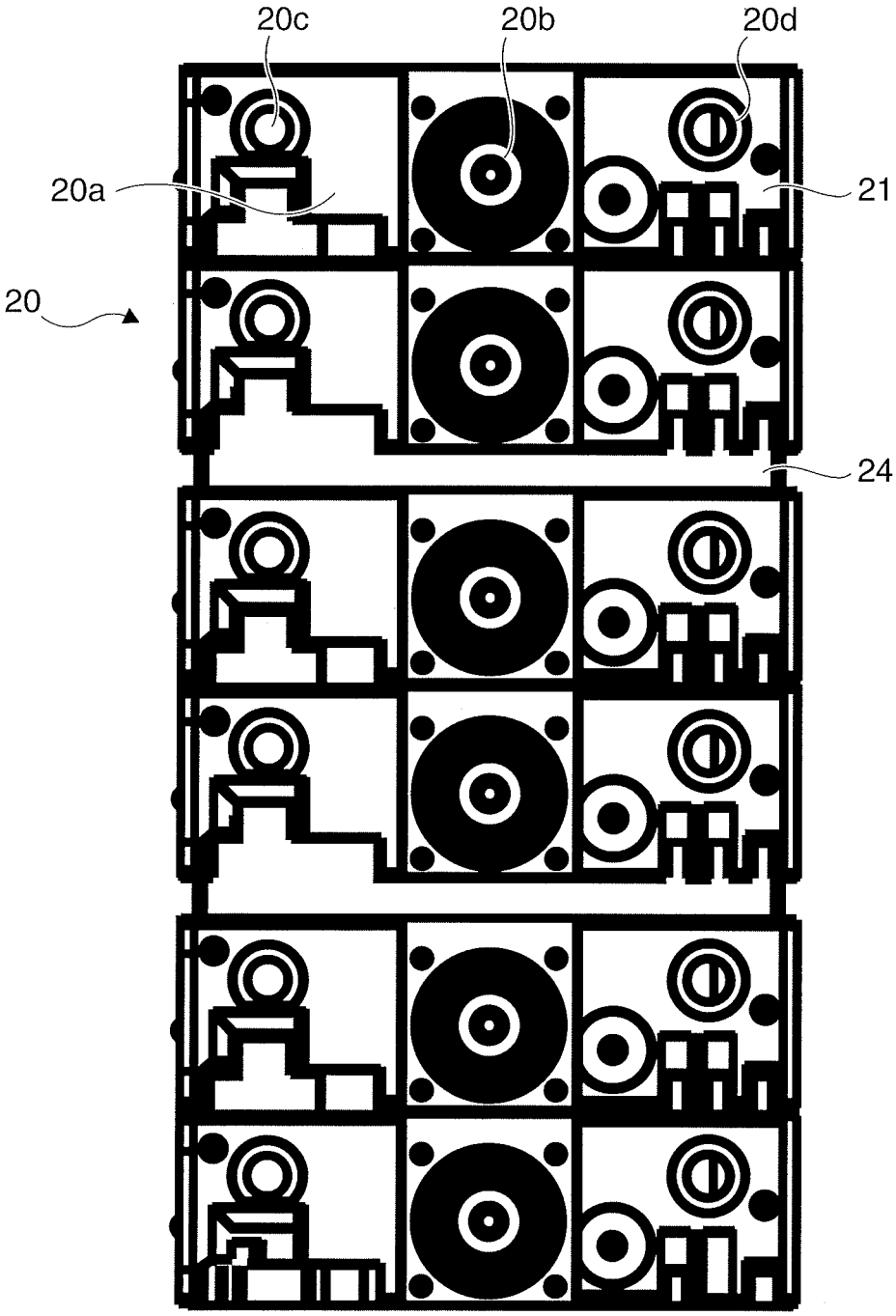
FIG. 3 is a back view of the cartridge assembly shown in FIG. 2.

FIG. 2 is a perspective view of a cartridge holder 10 into which a cartridge assembly 20 is installed, and FIG. 3 is a back view of the cartridge assembly 20. The cartridge holder 10 shown in FIG. 2 is fixed inside the cartridge compartment 2, and the cartridge assembly 20 including plural vertically connected ink cartridges 21 is removably installed into the cartridge holder 10. When the cartridge assembly 20 becomes empty, the user can open the cover 3 and replace the ink cartridges. Ink sealed inside the ink cartridges 21 is supplied to the printhead (not shown) of the printer 1, and the printer 1 can print on paper or any other recording medium by ejecting ink from the printhead.

As shown in FIG. 2, the cartridge holder 10 is a hollow box member with a cartridge assembly compartment 10*a* that is open to the front. The cartridge holder 10 is secured inside the cartridge compartment 2 of the printer 1 by fastening mounting feet 14 formed integrally to the cartridge holder 10 to the printer 1 with screws, for example. An ink supply hole 20*b* connected to the supply hole of a respective ink pack 23 (see FIG. 4), and a positioning hole 20*c* and rotation prevention hole 20*d* disposed on opposite sides of the ink supply hole 20*b* are provided to each ink cartridge 21 on the back 20*a* of the cartridge assembly 20, as shown in FIG. 3.

Of the side walls of the cartridge holder 10 that form the cartridge assembly compartment 10*a*, a plurality of supply needles 11 that communicate with the ink packs 23 inside the cartridge assembly 20 and supply the ink to the printer 1 are disposed through the surface (opposing surface) 10*b* that faces the back 20*a* of the cartridge assembly 20. These supply needles 11 are provided in a number equal to the number of connected ink cartridges 21, and are disposed in a vertical row opposite the ink supply holes 20*b* in the cartridge assembly 20.

A plurality of positioning pins 12 are also disposed in the opposing surface 10*b* of the cartridge holder 10. In addition to the two positioning pins 12 shown in the figure, this particular embodiment of the invention also has one positioning pin 12 disposed to the cartridge assembly 20 in a position that is hidden in the figure. The positioning pins 12 of the cartridge holder 10 are aligned in a vertical row on one side of the vertical row of the supply needles 11 so as to be opposite the positioning holes 20*c* in the cartridge assembly 20, respectively. The relative positions of the cartridge assembly 20 and cartridge holder 10 are fixed as a result of the positioning pins 12 being inserted into the positioning holes 20*c* of the cartridge assembly 20, respectively.

A plurality of rotation prevention pins 13 are disposed to the opposing surface 10*b* of the cartridge holder 10 and on the other side of the vertical row of the supply needles 11 so as to be opposite the rotation prevention holes 20*d* of the cartridge assembly 20. By inserting these rotation prevention pins 13 into the rotation prevention holes 20*d*, the rotation prevention pins 13 and positioning pins 12 together hold the cartridge assembly 20 against rotation relative to the cartridge holder 10. In some embodiments, one or more of the positioning pins 12 and/or rotation prevention pins 13 are provided on the cartridge assembly 20, and the respective one or more positioning holes 20*c* and/or rotation prevention holes 20*d* are provided on the cartridge holder 10.

Figure 4:
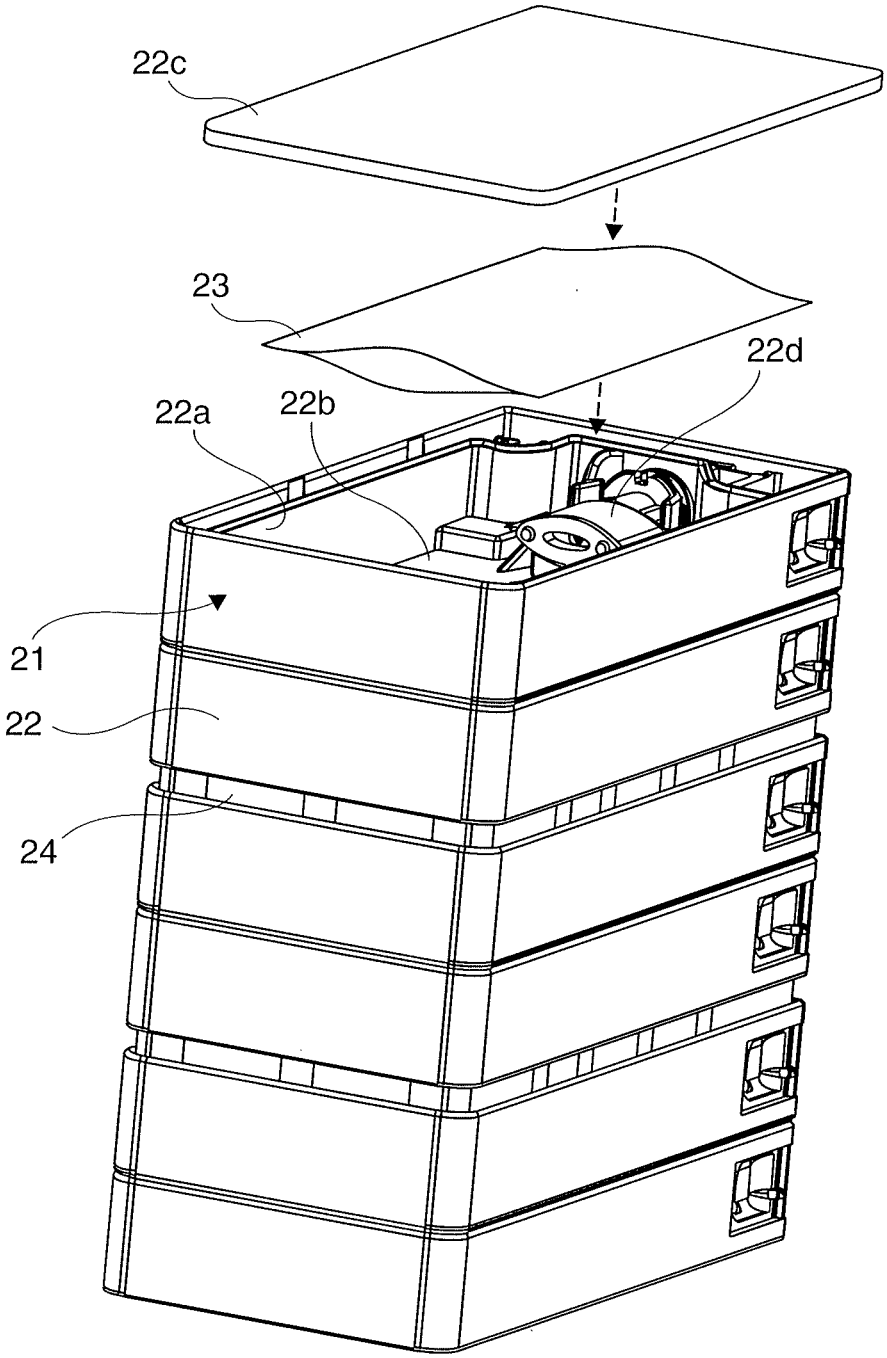
FIG. 4 is a partially exploded, perspective view of the cartridge assembly shown in FIG. 2.

FIG. 4 is a partially exploded, perspective view of the cartridge assembly 20. The cartridge assembly 20 has a plurality of ink cartridges 21 connected together in a vertical stack. Each ink cartridge 21 has a cartridge case 22 and an ink pack 23. The ink pack 23 is a sack-like member made of a flexible material such as plastic or metal foil with ink sealed inside. The plural ink packs 23 may all contain the same color of ink or different colors of ink. In embodiments where other printing technologies are used, e.g., laser printing, the ink cartridges include toner of the same color or different colors.

The cartridge case 22 has side walls 22*a*, a bottom 22*b*, and a case cover 22*c*, forming a space for holding the ink pack inside. The ink pack 23 is stored in this ink pack compartment and connected to a supply opening 22*d* formed inside the ink pack compartment. The top of the ink pack compartment is closed by the case cover 22*c*. Of the side walls 22*a* of the cartridge case 22, the ink supply hole 20*b*, positioning hole 20*c*, and rotation prevention hole 20*d* are formed in the back wall that opposes the opposing surface 10*b* of the cartridge holder 10.

Ink cartridges 21 are connected so that the bottom 22*b* of one ink cartridge 21 is adjacent to the case cover 22*c* of another ink cartridge 21. Two or more connected ink cartridges 21 form one ink cartridge set, and an elastic member 24 that is made from an elastic material, for example, rubber, foam, etc., is disposed between adjacent ink cartridge sets. In some embodiments, the ink cartridge sets do not necessarily have the same number of ink cartridges. In some embodiments, at least one individual ink cartridge and at least one ink cartridge set are connected together.

Figure 5:
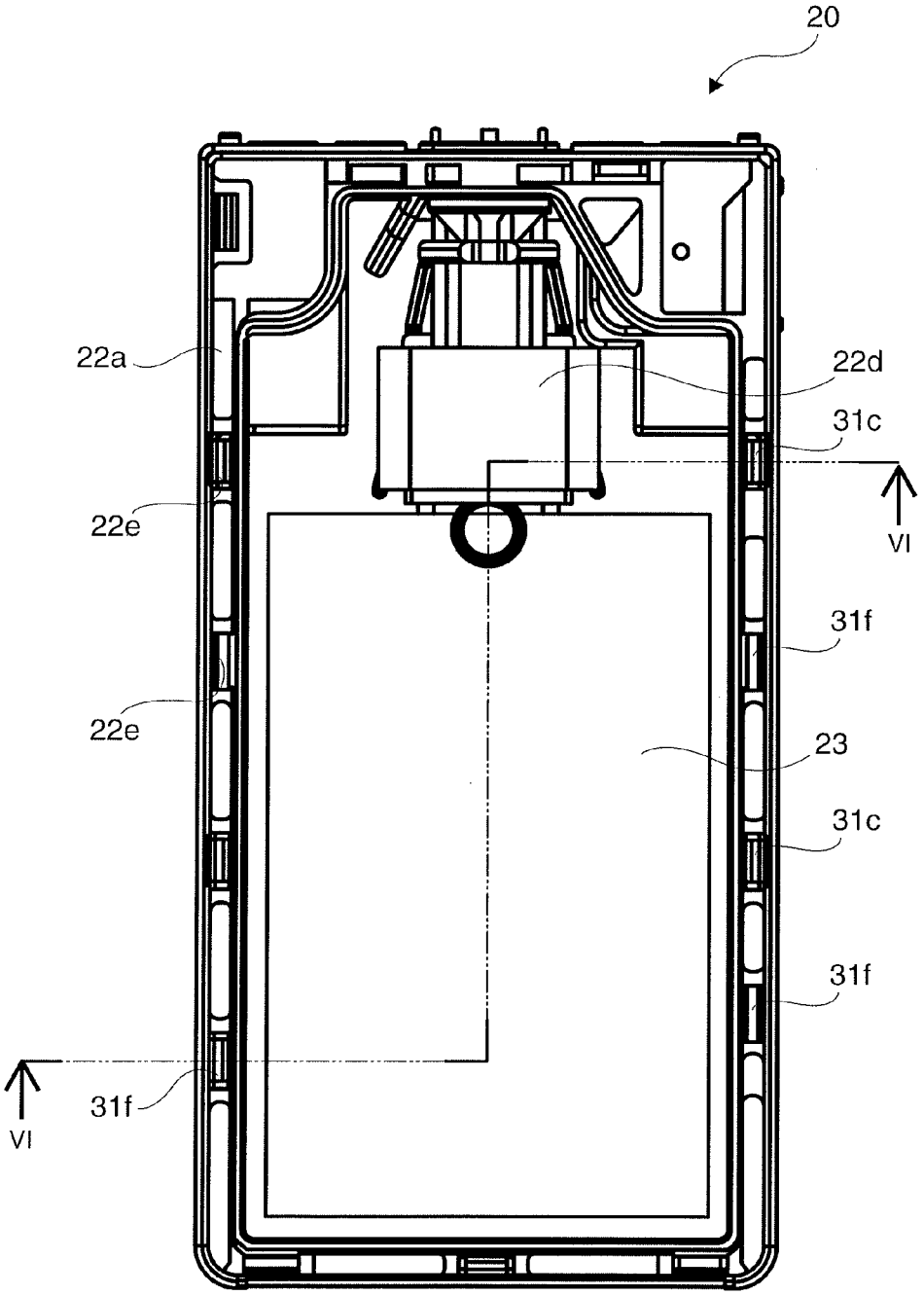
FIG. 5 is a open top view of the cartridge assembly shown in FIG. 2.
Figure 6:
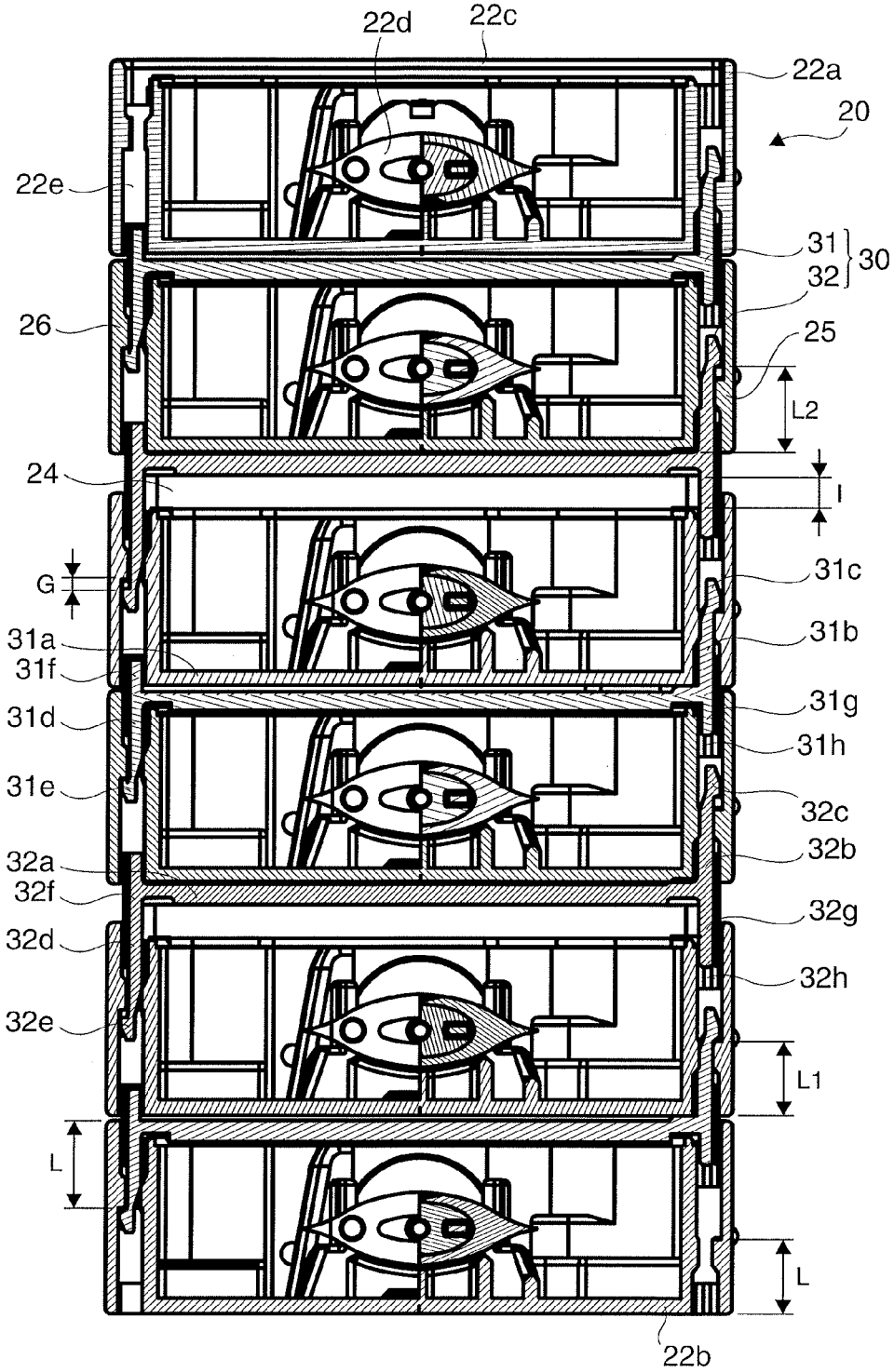
FIG. 6 is a section view taken along line VI-VI in FIG. 5.

A connecting mechanism 30 (connecting member) whereby the plural ink cartridges 21 are connected together is described next with reference to FIG. 5 and FIG. 6. FIG. 5 is an open top view of the ink cartridge 21 (with the case cover 22*c* removed), and FIG. 6 is a section view taken along line VI-VI in FIG. 5. The ink pack 23 is not shown in FIG. 6 for the sake of simplicity. The connecting mechanism 30 includes one or more, e.g., three, first connecting members 31 and one or more, e.g., two, second connecting members 32.

Each second connecting member 32 connects adjacent ink cartridges 21 while allowing the connected ink cartridges 21 to move relative to each other within a predetermined distance in the connection direction.

Each first connecting member 31 connects adjacent ink cartridges 21 while preventing the connected ink cartridges 21 from moving relative to each other in the connection direction. In some embodiments, one or more first connecting member 31 may permit limited relative movement (e.g., a play) of the connected ink cartridges 21 in the connection direction, e.g., due to manufacture-related dimension variations. However, such a limited relative movement is still shorter than the predetermined distance permitted by the second connecting member 32.

As used herein, the "connection direction" refers to the direction in which the ink cartridges 21 are stacked together, and is vertical in the particular embodiment seen in FIG. 6.

As shown in FIG. 5, a plurality of receiver holes 22*e* are disposed in the side wall 22*a* of the cartridge case 22. As shown in FIG. 6, a first shoulder (engaged part) 25 and a second shoulder (engaged part) 26 that narrow the receiver hole 22*e* are formed on the inside wall of each receiver hole 22*e*. The first shoulder 25 is disposed at a first specific distance, e.g., L in FIG. 6, from the top edge of the side wall 22*a*, and the second shoulder 26 is disposed at a second specific distance, e.g., L in FIG. 6, from the bottom edge of the side wall 22*a*. This specific distance L is the same in all cartridge cases 22. However, in some embodiments, the first specific distance is not necessarily the same as the second specific distance and/or the ink cartridges do not necessarily have the same first and/or second specific distance(s).

In each ink cartridge set, adjacent cartridge cases 22 (that is, the first and second cartridge cases 22, third and fourth cartridge cases 22, and fifth and sixth cartridge cases 22 from the top in the example shown in FIG. 6) are connected to each other by means of the first connecting members 31 so that the cartridge cases 22 in the same ink cartridge set cannot move relative to each other in the connection direction. In some embodiments as noted above, one or more first connecting member 31 may permit limited relative movement (shorter than the predetermined distance permitted by the second connecting member 32) between the connected cartridge cages 22 in the connection direction, e.g., due to manufacture-related dimension variations.

The first connecting member 31 is, in some embodiments, a 180 degree rotationally symmetric member when seen in cross section as shown in FIG. 6, but in further embodiments, the first connecting member 31 is not necessarily symmetrical. The first connecting member 31 has an interface part 31*a* that extends perpendicularly to the connection direction; a top leg (first protruding part) 31*b* that protrudes one way in the connection direction from the interface part 31*a*; a top claw (first engaging part) 31*c* disposed to the distal end of the top leg 31*b*; a bottom leg (first protruding part) 31*d* that protrudes the opposite way in the connection direction from the interface part 31*a*; and a bottom claw (first engaging part) 31*e* disposed to the distal end of the bottom leg 31*d*.

The top claw 31*c* and bottom claw 31*e* are formed at positions corresponding to the receiver holes 22*e* in the cartridge case 22, and can be inserted to the receiver holes 22*e*. The top leg 31*b* and bottom leg 31*d* extend in mutually opposite directions.

In some embodiments, the length L1 of the top leg 31*b* and bottom leg 31*d* of the first connecting member 31 is substantially the same as the first specific distance (e.g., L) from the first shoulder 25 to the top of the side wall 22*a* and the second specific distance (e.g., L) from the second shoulder 26 to the bottom end of the side wall 22*a*, respectively (e.g., L1=L). Therefore, when the top claw 31*c* and bottom claw 31*e* of the first connecting member 31 are inserted to the receiver holes 22*e* in the adjacent cartridge cases 22, the back end of the top claw 31*c* flexes to pass the narrowed portion of the respective receiver hole 22*e* then rests on the first shoulder 25, and the back end of the bottom claw 31*e* flexes to pass the narrowed portion of the respective receiver hole 22*e* then rests on the second shoulder 26, and the adjacent cartridge cases 22 are connected while being prevented from moving by the first connecting member 31.

In some embodiments where the first specific distance is not the same as the second specific distance, the lengths of the top leg 31*b* and bottom leg 31*d* are different and/or appropriately dimensioned so that the top claw 31*c* and bottom claw 31*e* engage the respective shoulders 25, 26 with no play in the connection direction between the adjacent cartridge cases 22 connected by the first connecting member 31.

In some embodiments as noted above, the first connecting member 31 may permit limited relative movement (shorter than the predetermined distance permitted by the second connecting member 32) between the connected cartridge cages 22 in the connection direction, e.g., due to manufacture-related dimension variations.

Adjacent ink cartridge sets have their adjacent cartridge cases 22 (that is, the second and third cartridge cases 22 and the fourth and fifth cartridge cases 22 from the top in the example shown in FIG. 6) movably connected to each other by means of the second connecting members 32 which permit the connected cartridge cases 22 to move relative to each other in the connection direction within a predetermined distance greater than that permitted (if at all) by the first connecting members 31.

The second connecting member 32 is, in some embodiments, a 180 degree rotationally symmetric member when seen in cross section as shown in FIG. 6, but in further embodiments, the second connecting member 32 is not necessarily symmetrical. The second connecting member 32 has an interface part 32*a* that extends perpendicularly to the connection direction of the cartridge case 22; a top leg (second protruding part) 32*b* that protrudes one way in the connection direction from the interface part 32*a*; a top claw (second engaging part) 32*c* disposed to the distal end of the top leg 32*b*; a bottom leg (second protruding part) 32*d* that protrudes the opposite way in the connection direction from the interface part 32*a*; and a bottom claw (second engaging part) 32*e* disposed to the distal end of the bottom leg 32*d*.

The top claw 32*c* and bottom claw 32*e* are formed at positions corresponding to the receiver holes 22*e* in the cartridge case 22, and can be inserted to the receiver holes 22*e*. The top leg 32*b* and bottom leg 32*d* extend in mutually opposite directions.

The length L2 of the top leg 32*b* and bottom leg 32*d* of the second connecting member 32 is greater than the first specific distance (e.g., L) from the first shoulder 25 to the top of the side wall 22*a* and the second specific distance (e.g., L) from the second shoulder 26 to the bottom of the side wall 22*a*, respectively, that is, L2>L. As a result, when the top claw 32*c* and bottom claw 32*e* of the second connecting member 32 are inserted to the receiver holes 22*e* in the adjacent cartridge cases 22, a gap (e.g., G) is formed between the back end of the top claw 32*c* and the first shoulder 25, and between the back end of the bottom claw 32*e* and the second shoulder 26. As a result, the adjacent cartridge cases 22 connected by the second connecting members 32 can move relative to each other in the connection direction within a predetermined distance defined by about twice this gap G.

The elastic member 24 is inserted between the ink cartridges 21 that are connected by these second connecting members 32. In the specific embodiment shown in FIG. 6, the elastic member 24 is inserted between the third cartridge case 22 and the second connecting member 32. The size (thickness) 1 of the elastic member 24 in the connection direction is preferably slightly greater than the difference between the length L2 of the top leg 32*b* and bottom leg 32*d* of the second connecting member 32, and length L (1>=L2−L).

When no external force is applied in the connection direction to the cartridge assembly 20, the gap G between the third cartridge case 22 and the second connecting member 32 is not formed, i.e., the back end of the bottom claw 32*e* contacts (i.e., engages or rests on) the second shoulder 26 of the third cartridge case 22. For example, the elastic member 24 elastically biases the ink cartridges 21 that are connected by the second connecting member 32 away from each other in the connection direction, to ensure that the bottom claw 32*e* engages the second shoulder 26 of the third cartridge case 22.

In some embodiments, a further elastic member (not shown) similar to the elastic member 24 is also inserted between the second cartridge case 22 and the second connecting member 32. When no external force is applied in the connection direction to the cartridge assembly 20, a gap between the second cartridge case 22 and the second connecting member 32 is not formed, i.e., the back end of the top claw 32*c* of the second connecting member 32 contacts (i.e., engages or rests on) the first shoulder 25 of the second cartridge case 22. For example, the further elastic member elastically biases the ink cartridges 21 that are connected by the second connecting member 32 away from each other in the connection direction, to ensure that the top claw 32*c* of the second connecting member 32 engages the first shoulder 25 of the second cartridge case 22. Thus, there is no play between the second and third cartridge cases 22 connected by the second connecting member 32.

If compressive force is applied in the connection direction to the cartridge assembly 20 (which is the state shown in FIG. 6), the elastic member 24 (and/or the further elastic member) is compressed in the connection direction, and the connected ink cartridges 21 can move relatively to each other within the predetermined distance (equal to about twice the gap G) in the connection direction.

In some embodiments, the top leg 32*b* (or the bottom leg 32*d*) of the second connecting member 32 is configured similarly to the top leg 31*b* (or the bottom leg 31*d*) of the first connecting member 31. As the result, the top leg 32*b* (or the bottom leg 32*d*) of the second connecting member 32, when inserted into the respective receiver hole 22*e*, engages (or rests on) the respective shoulder 25 of the second cartridge case 22 (or the shoulder 26 of the third cartridge case 22). Thus, there is only one gap G between the third cartridge case 22 and the second connecting member 32 (or between the second cartridge case 22 and the second connecting member 32). As a result, the second and third cartridge cases 22 connected by the second connecting members 32 can move relative to each other in the connection direction within a predetermined distance defined by the gap G, and only one elastic member 24 is used to absorb this gap G.

Thus, by appropriately dimensioning the lengths of the top leg 32*b* and bottom leg 32*d* and/or the thickness (es) of the elastic member (s) 24, when there is no external force applied in the connection direction to the cartridge assembly 20, the top claw 32*c* and bottom claw 32*e* engage the respective shoulders 25, 26 with no play in the connection direction between the second and third cartridge cases 22 connected by the second connecting member 32.

Extensions 31*f*, 32*f* and 31*g*, 32*g* are formed to the first connecting member 31 and second connecting member 32 on the ends opposite to the top legs 31*b*, 32*b* and bottom legs 31*d*, 32*d*. A damper 31*h*, 32*h* (e.g., a rubber ring or cap) is disposed around the outside of each of the extensions 31*g*, 32*g*. Unintended movement of the first connecting member 31 and second connecting member 32 relative to the cartridge case 22 is prevented or at least limited, and noise resulting from possible play of the first connecting member 31 and second connecting member 32 inside the receiver holes 22*e*, is prevented by pressing the outside of the dampers 31*h*, 32*h* against the inside of the respective receiver holes 22*e* in which the dampers 31*h*, 32*h* are received.

As shown in FIG. 5, a plurality of top claws 31*c* and bottom claws 31*e* are preferably connected to a common interface part 31*a* and rendered in unison with the first connecting member 31 so that the extensions 31*f* extending in the opposite direction from the top claws 31*c* are aligned with the neighboring top claws 31*c*. This prevents the ink cartridges 21 from coming apart when a pulling force is applied to the cartridge assembly 20, and keeps the cartridge assembly 20 firmly connected. In this case the interface part 31*a* is preferably a rectangular member of substantially the same size as the case cover 22*c*. This also applies to the second connecting member 32.

A cartridge assembly 20 constructed as described above can increase the ink storage capacity by connecting plural ink cartridges 21 together. When identical cartridge cases 22 are stacked together with no dimensional error in the plural cartridge cases 22, the size of the cartridge assembly 20 composed of these stacked cartridge cases 22 is always the same. As a result, there is no deviation in the positions of the positioning holes 20*c* in plural cartridge assemblies 20, and the positioning pins 12 disposed to the cartridge holder 10 at specific positions can be accurately inserted to the positioning holes 20*c*.

However, even when the sizes of the plural cartridge cases 22 vary due to manufacturing deviations, the positions of the positioning holes 20*c* of the cartridge assembly 20 can still be adjusted to match the positions of the positioning pins 12 of the cartridge holder 10 in the connection direction. This is because the adjacent ink cartridges 21 of the cartridge assembly 20 according to embodiments of the invention are connected by means of the second connecting members 32 described above so that they can move in the connection direction.

The positioning holes 20*c* of the cartridge assembly 20 can therefore be adjusted to the positioning pins 12 of the cartridge holder 10, and the cartridge assembly 20 can be easily installed into the cartridge holder 10. A cartridge assembly 20 with a large ink storage capacity can therefore be provided at low cost by connecting plural ink cartridges 21.

To fix the position of the ink cartridges 21 at both ends in the connection direction to the cartridge holder 10, positioning holes 20*c* are provided in the ink cartridges 21 located at the opposite ends of the cartridge assembly 20 in the connection direction, e.g., in the top (first) and bottom (last) ink cartridges 21 in FIG. 6. However, to prevent movement of the set of ink cartridges 21 between the second connecting members 32 (the third and fourth ink cartridges 21 from the top in the example shown in FIG. 6) relative to the cartridge holder 10, a positioning hole 20*c* is preferably disposed to each set of ink cartridges 21 between the second connecting members 32 in addition to the ink cartridges 21 located at the opposite ends of the cartridge assembly 20 in the connection direction. In some embodiments where the ink cartridges 21 are similarly configured and are each provided with a positioning hole 20*c*, the positioning pins 12 are preferably provided in the cartridge holder 10 to engage at least the respective positioning holes 20*c* in the ink cartridges 21 located at the opposite ends of the cartridge assembly 20 in the connection direction as well as in each set of ink cartridges 21 between the second connecting members 32.

Some foregoing embodiments describe connecting plural ink cartridges 21 in the vertical direction of the printer 1, but the ink cartridges 21 could be arranged side by side in the horizontal direction of the printer 1 in further embodiments.

Some foregoing embodiments describe a cartridge assembly 20 having a connecting mechanism 30 with three first connecting members 31 and two second connecting members 32 connecting six ink cartridges 21 together, but the number of ink cartridges 21, first connecting members 31, and second connecting members 32 is not so limited. For example, in the case of a cartridge assembly 20 with two ink cartridges 21, the ink cartridges 21 are connected to each other so that they can move in the connection direction using only the second connecting members 32.

In some embodiments, a kit for assembling a plurality of ink cartridges 21 into a cartridge assembly 20 is provided. The kit includes at least one second connecting member 32 for connecting two ink cartridges 21 together as described above. The kit also includes at least an elastic member 24 for absorbing a gap between the connected ink cartridges 21. The kit also includes one or more first connecting members 31 to connected the ink cartridges 21 into one or more ink cartridge sets which are further connected by the second connecting member (s) 32. The number of first connecting members 31 and/or second connecting members 32 and/or elastic members 24 is/are variable depending on the desired size and/or configuration of the cartridge assembly to be made.

In an aspect, the assembled cartridge assembly enables adjusting the distance between the two ink cartridges connected by the second connecting member in the connection direction of the cartridge case. Thus, positions of the positioning parts (e.g., holes or pins) in the cartridge assembly can be adjusted even when plural ink cartridges with dimensional deviations are connected together to increase the ink storage capacity. The positioning parts of the cartridge assembly can therefore be easily adjusted to correspond to the matching positioning parts (e.g., pins or holes) of the cartridge holder, and the cartridge assembly can be easily installed into the cartridge holder. Thus, a cartridge assembly with a high ink storage capacity at low cost is provided by connecting plural existing ink cartridges together into a single unit.

In a further aspect, some ink cartridges are connected, e.g., with a first connecting member, so that they cannot move relative to each other, whereas other ink cartridge are connected, e.g., with a second connecting member, so that they can move relative to each other in the connection direction. Thus, plural identically (or similarly) shaped cartridge cases with identically (or similarly) shaped engaged parts are assembled to provide a cartridge assembly at low cost.

In a further aspect, the cartridge assembly can easily reduce the gap between adjacent cartridge cases by means of elastic compression of an interposed elastic member. In addition, because the elastic member intervenes between the cases, noises caused by contact between the cartridge cases can be suppressed even when movement between the cartridge cases is allowed by the connecting member.

In a further aspect, a cartridge holder is provided to receive therein the cartridge assembly, with a positioning part (e.g., pin or hole) of the cartridge holder positioned corresponding to a matching positioning part (e.g., hole or pin) of the cartridge case. A printer including the cartridge holder is provided with a printing mechanism (e.g., a printhead) for printing with ink supplied from the ink cartridge. Thus, a high ink capacity cartridge assembly can be installed in such a printer at low cost, and enables the printer to print with a long interval between ink cartridge replacements.

Although various embodiments have been described, it will be apparent that the embodiments may be varied in many ways. Such variations are intended to be included within the scope of the following claims.

What is claimed is:

1. A kit for assembling a plurality of ink cartridges in a connection direction into a cartridge assembly, said kit comprising:

at least one first connecting member including a first interface part configured to be placed between adjacent ink cartridges to be connected by the first connecting member;

at least two first protruding parts that extend from the first interface part in mutually opposite ways along the connection direction, and a first engaging part disposed at the distal end of each first protruding part for engagement with engaged parts of the adjacent ink cartridges so that the ink cartridges are not moveable relative to each other in the connection direction or are moveable relative to each other in the connection direction within a limited play; and at least one second connecting member including a second interface part adapted to be placed between adjacent ink cartridges to be connected by the second connecting member;

at least two second protruding parts that extend from the second interface part in mutually opposite directions along the connection direction, and a second engaging part disposed at the distal end of each second protruding part for engagement with engaged parts of the adjacent ink cartridges so that the adjacent ink cartridges connected by the second connecting member are moveable relative to each other in the connection direction within a predetermined distance greater than the limited play permitted by the first connecting member; and at least one elastic member adapted to be disposed between the adjacent ink cartridges connected by the second connecting member, and elastically deformable to enable the adjacent ink cartridges connected by the second connecting member to move relative to each other in the connection direction within the predetermined distance.

2. The kit of claim 1, wherein a first distance from at least one of the first engaging parts to the first interface part is shorter than a second distance from at least one of the second engaging parts to the second interface part.

3. The kit of claim 2, wherein the first engaging parts are at the same distance to the first interface part.

4. The kit of claim 2, wherein a thickness of the elastic member is greater than a difference between the first and second distances.

5. The kit of claim 1, wherein the first engaging parts are equally spaced at a third distance from the first interface part;

one of the second engaging parts is spaced at the third distance from the second interface part;

another second engaging part is spaced at a fourth distance from the second interface part, the fourth distance being greater than the third distance; and a thickness of the elastic member is greater than a difference between the third and fourth distances.

6. A cartridge assembly, comprising:

a plurality of ink cartridges each having a cartridge case that holds ink therein; and a plurality of connecting members including a first connecting member and a second connecting member configured to connect the plurality of ink cartridges together in a connection direction;

wherein the ink cartridges connected by the second connecting member are movable relative to each other in the connection direction within a predetermined distance; and the ink cartridges connected by the first connecting member are not moveable relative to each other in the connection direction.

7. The cartridge assembly of claim 6, wherein the first connecting member has at least two first protruding parts that extend in mutually opposite ways along the connection direction, and a first engaging part disposed to the distal end of each first protruding part;

the second connecting member has a plurality of second protruding parts which extend in mutually opposite directions along the connection direction, and at least one of which is longer than the first protruding part that extends in the same way as the second protruding part along the connection direction, and a second engaging part disposed to the distal end of each of the second protruding parts;

the cartridge case of each of the ink cartridges has engaged parts engageable with the first engaging parts and the second engaging parts;

the first connecting members connect adjacent ink cartridges by means of the two first engaging parts engaging the corresponding engaged parts of the adjacent ink cartridges so that the ink cartridges are not moveable relative to each other in the connection direction; and the second connecting members connect adjacent ink cartridges by means of the second engaging parts engaging the corresponding engaged parts of the adjacent ink cartridges so that the ink cartridges are moveable relative to each other in the connection direction.

8. The cartridge assembly of claim 7, further comprising:

an elastic member that is disposed between the adjacent ink cartridges connected by the second connecting member, and is elastically deformable to enable the adjacent ink cartridges to move relative to each other in the connection direction within the predetermined distance.

9. The cartridge assembly of claim 8, wherein the elastic member biases the adjacent ink cartridges connected by the second connecting member away from each other in the connection direction and causes the second engaging parts to engage the corresponding engaged parts unless a compressive force is applied to the cartridge assembly in the connection direction.

10. The cartridge assembly of claim 9, wherein the elastic member is disposed between the second connecting member and one of the adjacent ink cartridges connected by the second connecting member.

11. The cartridge assembly of claim 6, further comprising:

positioning parts disposed to the cartridge cases of at least two of the ink cartridges for alignment with matching positioning parts of a cartridge holder into which the cartridge assembly is to be installed.

12. The cartridge assembly of claim 11, wherein the positioning parts of the cartridge assembly include insertion holes.

13. A printer, comprising:

a cartridge holder having a cartridge assembly compartment;

a cartridge assembly as defined in claim 6 and installable in the cartridge assembly compartment; and a printing mechanism for printing with ink supplied from the ink cartridge.

14. The printer of claim 13, wherein positioning parts are disposed to the cartridge cases of at least two of the ink cartridges of the ink cartridge assembly; and matching positioning parts are disposed to the cartridge holder for alignment and engagement with the positioning parts of the ink cartridge assembly, respectively.

15. The printer of claim 14, wherein the at least one connecting member includes a first connecting member and a second connecting member;

the ink cartridges connected by the second connecting member are movable relative to each other in the connection direction within a predetermined distance;

the ink cartridges connected by the first connecting member are not moveable relative to each other in the connection direction, or are moveable relative to each other in the connection direction within a play shorter than the predetermined distance permitted by the second connecting member;

the ink cartridges include a plurality of ink cartridge sets;

in each of the ink cartridge sets, the adjacent ink cartridges are connected with each other in the connection direction by at least one said first connecting member;

the adjacent ink cartridges of the adjacent ink cartridge sets are connected with each other in the connection direction by at least one said second connecting member; and the matching positioning parts of the cartridge holder are arranged for alignment and engagement with (a) the positioning parts of the first and last ink cartridges in the ink cartridge assembly, and (b) the positioning parts of at least one ink cartridge in each of the ink cartridge sets.

* * * * *